United States Patent [19]

Kii

[11] 4,264,794

[45] Apr. 28, 1981

[54] CIRCUIT INTERRUPTER INCLUDING ARC EXTINGUISHING FLUID PRESSURIZATION MEANS AND PRESSURE ACCUMULATING MEANS

[75] Inventor: Masami Kii, Amagasaki, Japan

[73] Assignee: Mitsubishi Denki Kabushiki Kaisha, Tokyo, Japan

[21] Appl. No.: 889,549

[22] Filed: Mar. 23, 1978

[30] Foreign Application Priority Data

Mar. 24, 1977 [JP] Japan ..... 52/32900
Mar. 24, 1977 [JP] Japan ..... 52/32903

[51] Int. Cl.[3] ..... H01H 33/74

[52] U.S. Cl. ..... 200/148 XA; 200/150 D; 200/150 G

[58] Field of Search ..... 200/148 R, 148 A, 148 B, 200/148 C, 148 D, 148 E, 148 F, 148 G, 148 H, 148 J, 148 BV, 150 D, 150 G

[56] References Cited

U.S. PATENT DOCUMENTS 4,139,752 2/1979 Itai et al. .

*Primary Examiner*—J. V. Truhe
*Assistant Examiner*—Morris Ginsburg
*Attorney, Agent, or Firm*—Robert E. Burns; Emmanuel J. Lobato; Bruce L. Adams

[57] ABSTRACT

A circuit interrupter comprising an interrupting unit including an arc extinguishing chamber containing an arc extinguishing fluid and a pair of separable contacts disposed within the arc extinguishing chamber. The interrupter also comprises a fluid pressurizing means for compressing the arc extinguishing fluid in response to the contact opening operation and puffing the compressed fluid at an electric arc established between the separated contacts, and a pressure storing means for temporarily storing the compressed high pressure fluid for puffing the arc extinguishing fluid with the stored fluid pressure upon a decrease of the arc current to the zero value.

6 Claims, 3 Drawing Figures

CIRCUIT INTERRUPTER INCLUDING ARC EXTINGUISHING FLUID PRESSURIZATION MEANS AND PRESSURE ACCUMULATING MEANS

BACKGROUND OF THE INVENTION

1. Field of the Invention

This invention relates to circuit interrupters wherein an arc extinguishing fluid such as $SF_6$ gas is utilized to extinguish an electric arc.

2. Description of the Prior Art

It has been a common practice in a circuit interrupter using a gas having a strong arc extinguishing capability such as $SF_6$ gas to generate a pressure difference in the gas by a suitable means and to puff the high pressure gas to an electric arc to be extinguished, thereby effecting current interruption. There has been known two types of means for establishing the above mentioned pressure difference.

One type of circuit interrupter known as the double pressure type comprises a gas filled at a predetermined pressure within a casing in which $SF_6$ gas is also filled and a separate pressure generating apparatus for generating a high pressure, thereby obtaining the necessary pressure difference for generating a flow of the gas for arc extinction. Upon interruption, a valve disposed between the high pressure gas and the low pressure gas is opened in response to the contact opening operation to allow the high pressure gas to flow toward the arc, thereby blowing out the electric arc. With this type of circuit interrupter, the pressure generating apparatus for generating high pressure and maintaining it and two pressure systems for high and low pressure gases are separately constructed, so that the overall structure of the interrupter is extremely complicated and large, rendering it uneconomical. Besides, it is disadvantageous from a practical view point in that the high pressure of the gas must always be maintained.

The second type of circuit interrupter is known as a single pressure puffer-type wherein a puffer device disposed within a gas of a few atmospheres pressure filled in a sealed casing is operated in response to the interrupting operation to generate a high pressure gas, which gas is then puffed to the electric arc to extinguish it. This type of circuit interrupter utilizes compressed gas of a pressure lower than that used in the double pressure type, so that designing of a practical casing structrure is easier. However, the circuit interrupter requires a mechanical pressure generating device such as a puffer device operable in response to the interrupting operation. The puffer device requires a stronger driving force for a higher input electrical power and a higher interrupting current, inevitably resulting in the provision of a powerful operating mechanism in a large capacity circuit interrupter. It is also proposedto assist the large operating mechanism with an electromagnetically operated puffer device, but this operating mechanism is also disadvantageous in that it is large-sized, complicated in structure, not economical and not practical.

SUMMARY OF THE INVENTION

Accordingly, the chief object of the present invention is to provide a circuit interrupter having a large capacity and exhibiting improved interrupting performance over a wide range of current values.

With the above object in view, the present invention resides in a circuit interrupter comprising an arc extinguishing chamber containing an arc extinguishing fluid such as $SF_6$ gas and having disposed therein a pair of separable contacts. The circuit interrupter is so constructed as to supply a pressurized fluid to an electric arc established between the separated contacts in response to the contact opening operation, and to temporarily store the high pressure fluid pressure-raised by the arc, which stored high pressure fluid is puffed at the arc when the arc current decreases to zero. That is, the circuit interrupter of the present invention is a large capacity type interrupter exhibiting good interrupting performance over a wide range of current values, which exhibits the excellent interrupting characteristics of the self-extinguishing type interrupter for a massive current, wherein the arc extinction is effected by utilizing the blasting, diffusing and cooling functions due to the dissociation, separation and ionization functions of an electric arc, and the good interrupting characteristics of the small puffer device are utilized.

BRIEF DESCRIPTION OF THE DRAWINGS

The present invention will become more readily apparent from the following description of the preferred embodiments of the invention taken in conjunction with the accompanying drawings, in which.

DESCRIPTION OF THE PREFERRED EMBODIMENTS

Figure 1:
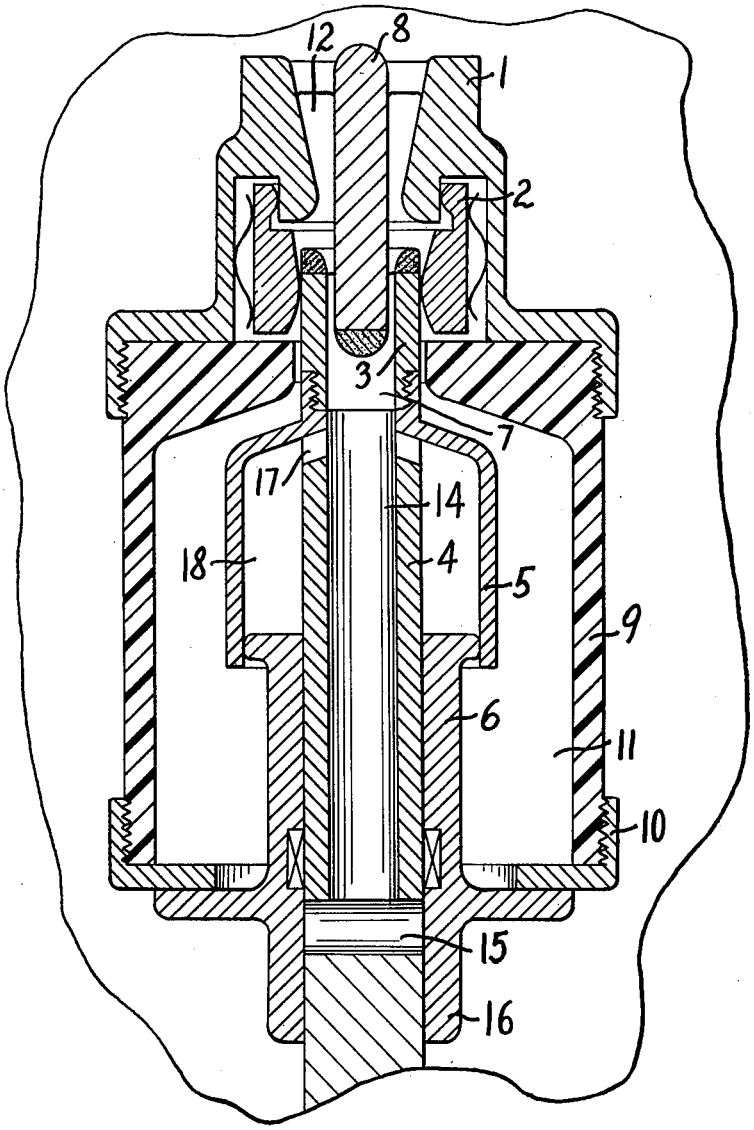
FIG. 1 is a sectional view illustrating a circuit interrupter embodying the present invention.

Referring now to the drawings and in particular to FIG. 1 thereof, a stationary contact 2 is supported by a contact flange 1. The stationary contact 2 is disposed for contacting and for being separated from a cylindrical movable contact 3 which is movable up and down as viewed from the figure by a well-known operating mechanism (not shown) together with a movable contact rod 4. The contact rod 4 is provided with a puffer cylinder 5 having a relatively small interior volume. The puffer cylinder 5, together with a puffer piston 6 fixed to a stationary member, a communicating port 17 and an upper vent opening 12 together comprise mechanical fluid pressurizing means for pressurizing arc extinguishing fluid during contact element separation and for blasting the pressurized arc extinguishing fluid to extinguish the electric arc. The upper end of the puffer cylinder 5 is communicated with a flow path 7 of a hollow cylindrical portion of the movable contact 3. The movable contact 3 and flow path 7 extend a sufficient distance to be closed by an arc contact 8 supported by the contact flange 1 when the circuit interrupter is closed, thereby assisting in pressure-raising the fluid in the puffer cylinder 5 upon interruption. An insulating cylinder 9 formed of a cylindrical, electrically insulating member is secured at the lower flange of the contact flange 1, and a lower flange 10 fixed to a lower supporting member is secured at the lower end of the insulating cylinder 9, whereby the contact flange 1, the insulating cylinder 9 and the lower flange 10 define an arc extinguishing chamber 11 or pressure accumulating means having a predetermined interior volume.

The contact flange 1 has formed therein the annular vent opening 12 in its center around the arc contact 8. The vent opening has a cross sectional area effective for suppressing excess pressure raising in the arc extinguishing chamber 11. The movable contact rod 4 has formed therein a vent path 14 which has at its lower end a vent opening 15. The vent opening 15 is closed by a closure wall 16 formed in the lower end of the puffer piston 6 until sufficient pressure-raising is obtained in the arc extinguishing chamber 11 at the initial stage of the contact opening operation. This does not impede the pressure-raising in the puffer cylinder 5. The puffer chamber 18 and the flow path 7 communicate with each other by the communicating port 17.

When the unillustrated operating mechanism is operated by a trip command, the movable contact rod 4 is driven downward to separate the movable contact 3 from the contact 2 after covering a predetermined wiping distance. During this operation, the arc extinguishing fluid within the puffer chamber 18 of the puffer device or the fluid pressurizing means comprised of the puffer cylinder 5 and the puffer piston 6 is increased in pressure to the value necessary for interruption because the flow path 7 and the vent opening 15 are closed by the arc contact 8 and the closure wall 16, respectively. Further downward movement of the movable contact rod 4 causes an electric arc established between the contacts 2 and 3 to transfer into the position between the movable contact 3 and the arc contact 8. The electric arc extends with the downward movement of the movable contact rod 4.

Under these circumstances, when the interruption current is relatively small and the pressure in the arc extinguishing chamber 11 does not reach the value necessary for interruption, the puffer device compensates to increase the pressure to rapidly extinguish the electric arc. When the current is high enough and a sufficient pressure is established within the arc extinguishing chamber 11, the high pressure arc extinguishing fluid flows through the movable contact 3 and the vent opening 12 as the arc current decreases to zero, thereby puffing the fluid at the electric arc established between the movable contact 3 and the arc contact 8 to rapidly extinguish the arc. The vent path 14 in the movable contact rod 4, the vent opening 15 in the contact rod 4 and the closure wall 16 together comprise means for establishing fluid communication from the arc extinguishing chamber 11 to the interior of the casing through the arcing region when the contact elements separate beyond a predetermined distance from each other.

Since the pressure value and the amount of the compressed fluid within the puffer device necessary for small current interruption are not very large, a small puffer device may be used resulting in a small operating force. Thus, even when a massive current is to be interrupted, the pressure increase in the arc extinguishing chamber 11 due to the arc energy complements the pressure increase in the puffer chamber to prevent an increase in the necessary operating force, resulting in a circuit interrupter which is small-sized, economical and of high performance.

Figure 2:
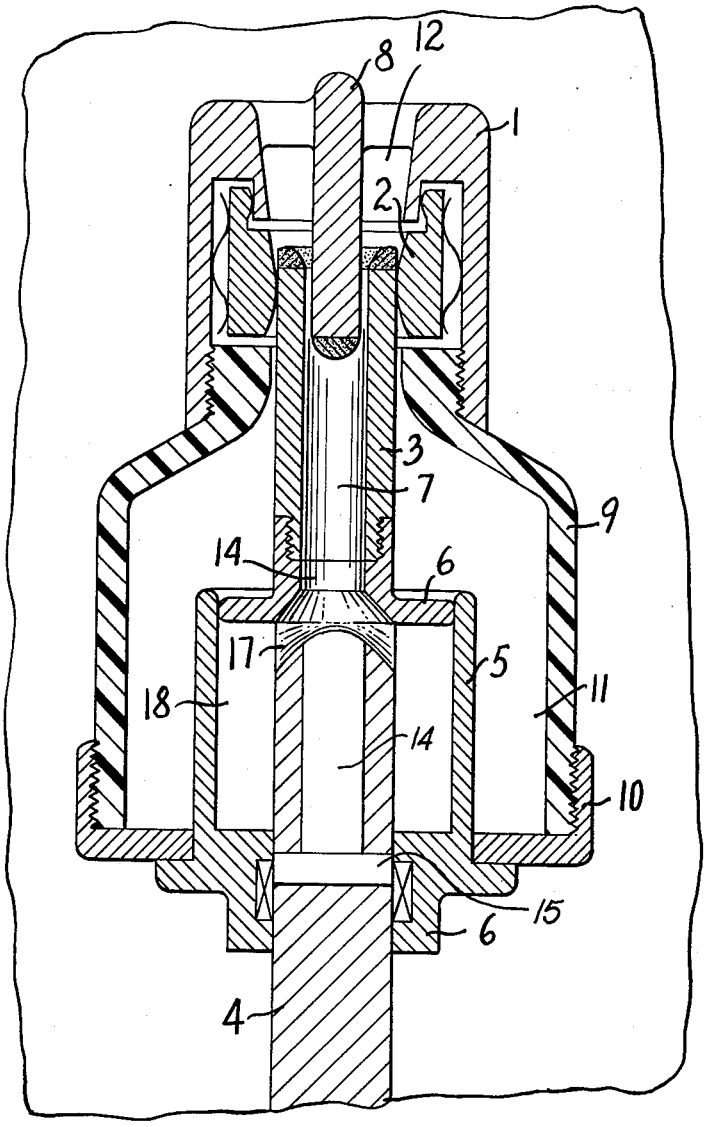
FIG. 2 is a sectional view illustrating another circuit interrupter embodying the present invention.

FIG. 2 illustrates another embodiment of the present invention which has the same construction as the circuit interrupter shown in FIG. 1 except that the puffer piston 6 is a movable element in the interrupter in FIG. 2, while the puffer cylinder 5 is movable in FIG. 1.

Figure 3:
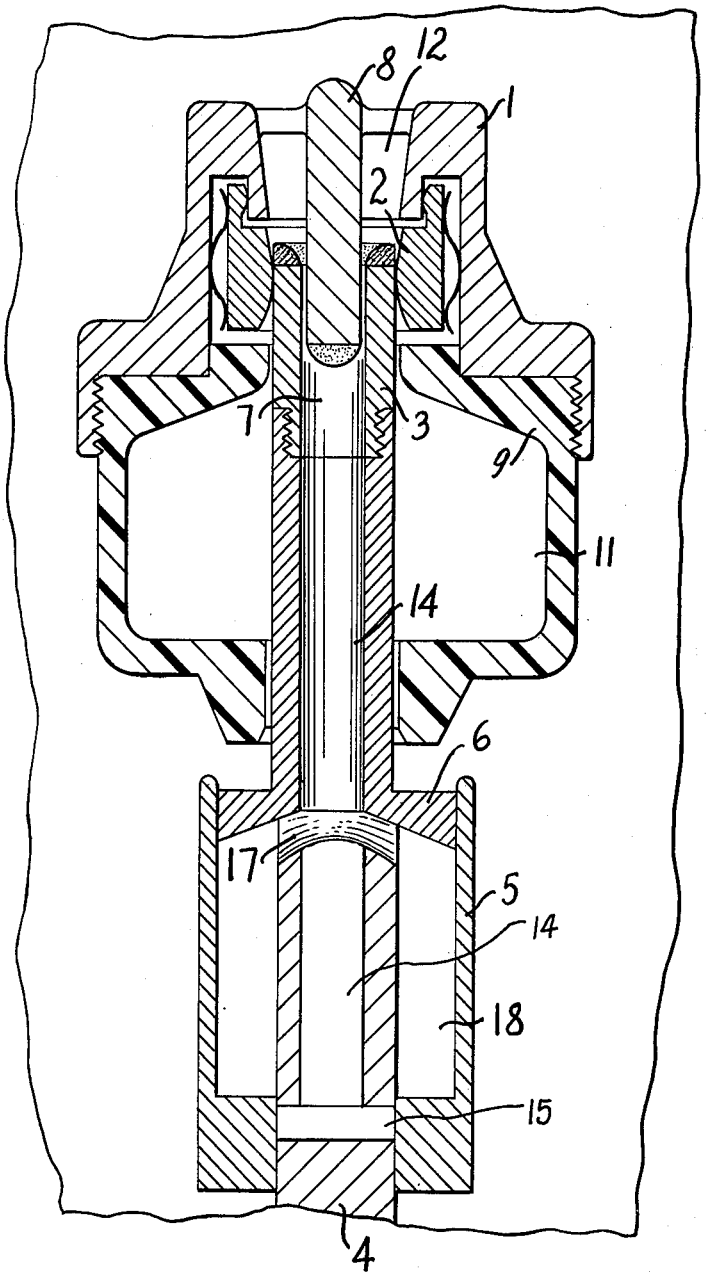
FIG. 3 is a sectional view illustrating still another circuit interrupter constructed in accordance with the present invention.

FIG. 3 illustrates still another circuit interrupter embodying the present invention, wherein the puffer device and the arc extinguishing chamber 11 are disposed in a series relationship with respect to the direction of the movement of the movable contact 3, and the puffer device is not enclosed by the arc extinguishing chamber. In other respects, the circuit interrupter is similar to the other embodiments described above.

What is claimed is:

1. A gas-blast type circuit interrupter, comprising:

a casing containing an arc extinguishing fluid;

a pair of electric contact elements disposed within said casing, at least one of said contact elements being movable between a closed position and separated positions wherein an electric arc is established in use in an arcing region between the separated contact elements;

mechanical fluid pressurizing means including a puffer chamber disposed within said casing for pressurizing said arc extinguishing fluid during the separating movement of said movable contact element and for blasting the pressurized arc extinguishing fluid at the electric arc to extinguish the arc;

pressure accumulating means, including an arc extinguishing chamber having an inner volume at all times relatively larger than the volume of said puffer chamber, for receiving the arc extinguishing fluid pressurized by the electric arc and for accumulating the arc extinguishing fluid under pressure; and means for establishing fluid communication from said arc extinguishing chamber to the interior of said casing through said arcing region when the contact elements separate beyond a predetermined distance from each other during the separating movement of said movable contact element, thereby blasting the pressurized arc extinguishing fluid accumulated within said arc extinguishing chamber at the electric arc to extinguish the electric arc.

2. A circuit interruper as claimed in claim 1, wherein said mechanical fluid pressurizing means comprises a piston and a piston cylinder having said piston disposed therein for compressing arc extinguishing gas within said piston cylinder.

3. A circuit interrupter as claimed in claim 2, wherein said piston cylinder is stationary within said arc extinguishing chamber and said piston is movable within said piston cylinder and is connected to said movable contact element for compressing arc extinguishing gas within said piston cylinder as said contact elements separate.

4. A circuit interrupter as claimed in claim 2, wherein said piston is stationary within said arc extinguishing chamber and said piston cylinder is movable relative to said piston and is connected to said movable contact element for compressing arc extinguishing gas within said piston cylinder as said contact elements separate.

5. A circuit interrupter as claimed in claim 1, wherein said puffer chamber is disposed within said arc extinguishing chamber.

6. A circuit interrupter as claimed in claim 1, wherein said arc extinguishing chamber and said puffer chamber are disposed in tandem in the direction of the contact element movement.

* * * * *